US005354049A

United States Patent [19]

Matherne et al.

[11] Patent Number: 5,354,049

[45] Date of Patent: Oct. 11, 1994

[54] APPARATUS AND METHOD FOR PACKAGING A PORTABLE BASKETBALL SYSTEM

[76] Inventors: Lonny R. Matherne, #10 Chimes Cir., Ogden, Utah 84405; Barry D. Mower, 3310 E. Twin Peaks Dr., Layton, Utah 84040

[21] Appl. No.: 100,054

[22] Filed: Jul. 30, 1993

Related U.S. Application Data

[63] Continuation-in-part of Ser. No. 13,611, Feb. 4, 1993, Pat. No. 5,248,140, and a continuation-in-part of Ser. No. 941,989, Sep. 8, 1992, Pat. No. 5,259,612.

[51] Int. Cl.[5] ..... A63B 63/08

[52] U.S. Cl. ..... 273/1.5 R; 206/315.1; 206/579; 220/375; 248/514; 248/519; 248/910

[58] Field of Search ..... 273/1.5 R, 1.5 A; 206/315.1, 579; 248/519–529, 910, 514, 515, 230; 220/375; 403/85, 88, 73

[56] References Cited

U.S. PATENT DOCUMENTS

| | | | |
|---|---|---|---|
| 169,181 | 10/1875 | Leonard . | |
| 193,015 | 7/1877 | McCarthy . | |
| 419,137 | 1/1890 | Bobemerith . | |
| 589,261 | 8/1897 | Koch et al. . | |
| 650,211 | 5/1900 | Wirth . | |
| 1,090,291 | 3/1914 | Engelhart . | |
| 1,310,323 | 7/1919 | Centolella . | |
| 1,504,292 | 8/1924 | Wickes . | |
| 1,667,887 | 5/1928 | Fallert . | |
| 1,669,169 | 5/1928 | Moss . | |
| 1,906,622 | 5/1933 | Kondolf . | |
| 1,924,811 | 8/1933 | Schultz | 273/1.5 |
| 1,926,674 | 9/1933 | Gross | 273/1 |
| 2,227,310 | 12/1940 | Hoppes et al. | 273/1.5 |
| 2,230,813 | 2/1941 | Pressman | 273/1.5 |
| 2,230,813 | 2/1941 | Pressman | 273/1.5 |
| 2,457,908 | 1/1949 | Meyerhoefer | 285/163 |
| 2,500,720 | 3/1950 | Van Der Heem | 285/161 |
| 2,519,466 | 8/1950 | Hauser | 45/137 |
| 2,534,067 | 12/1950 | Rubin | 273/1.5 |
| 2,594,628 | 4/1952 | Evans | 229/6 |
| 2,757,888 | 8/1956 | Branstrator | 248/4 |
| 2,791,363 | 5/1957 | Boeye | 229/16 |
| 2,818,254 | 12/1957 | Dunn | 273/1.5 |
| 2,865,133 | 12/1958 | Hoven et al. | 45/137 |
| 2,898,065 | 8/1959 | Ackley | 248/40 |

(List continued on next page.)

FOREIGN PATENT DOCUMENTS 1012572 7/1957 Fed. Rep. of Germany .

(List continued on next page.)

OTHER PUBLICATIONS

Huffy Sports, "A World Full of Family Fun," Product Brochure.

(List continued on next page.)

*Primary Examiner*—William H. Grieb
*Attorney, Agent, or Firm*—Madson & Metcalf

[57] ABSTRACT

A portable basketball system that in a preassembled state is capable of disposition within an outer relatively flat container to assist in shipping. The basketball system comprises a pole, a backboard, a basketball goal, and a hollow ballast-receiving base. The pole has a proximate end and a distal end and comprises a plurality of pole sections. The backboard may be connected to the pole near the distal end of the pole. The basketball goal may be connected to the backboard. The hollow ballast-receiving base supports the pole in a stationary, substantially upward position when connected to the pole near the proximate end of the pole. This provides a pole upon which the basketball goal may be suspended at an elevation above a playing surface and the base. The base has a top and a bottom and an exterior contour for receiving and retaining the pole sections, backboard, and basketball goal within the container during preassembly thereby impeding shifting movement of the pole sections, backboard, and basketball goal within the container during shipping. The exterior contour of the base comprises a backboard recess disposed on the bottom of the base for receiving and retaining the backboard within the container, a goal recess disposed on the top of the base for receiving and retaining the basketball goal within the container, and a pair of notches disposed on the top of the base each notch for receiving and retaining at least one of the pole sections within the container.

24 Claims, 7 Drawing Sheets

U.S. PATENT DOCUMENTS

| | | | |
|---|---|---|---|
| 2,930,559 | 3/1960 | Lohr | 248/44 |
| 3,017,183 | 1/1962 | Chalcroft | 273/1.5 |
| 3,025,058 | 3/1962 | Brumfield | 273/1.5 |
| 3,027,061 | 3/1962 | Locke | 229/16 |
| 3,094,303 | 6/1963 | Belger | 248/40 |
| 3,161,395 | 12/1964 | Carter | 248/354 |
| 3,184,207 | 5/1965 | Hermanns et al. | 248/413 |
| 3,194,555 | 7/1965 | Humphyey | 273/1.5 |
| 3,376,068 | 4/1968 | Walkinshaw | 297/437 |
| 3,399,889 | 8/1968 | Harry | 273/1.5 |
| 3,427,025 | 2/1969 | Procter | 273/1.5 |
| 3,469,870 | 9/1969 | Barkus | 287/58 |
| 3,497,057 | 2/1970 | Traner et al. | 206/44.11 |
| 3,614,143 | 10/1971 | Stevens | 287/126 |
| 3,697,103 | 10/1972 | Mostyn | 287/58 CT |
| 3,716,234 | 2/1973 | Lancellotti | 273/1.5 R |
| 3,731,897 | 5/1973 | Price | 248/230 |
| 3,780,933 | 12/1973 | Freeman | 229/40 |
| 3,788,642 | 1/1974 | Matras et al. | 273/1.5 R |
| 3,795,396 | 3/1974 | Kropelnitski | 272/59 C |
| 3,802,702 | 4/1974 | Pulley | 273/1.5 R |
| 3,820,784 | 6/1974 | Boitano et al. | 273/1.5 R |
| 3,830,008 | 8/1974 | Johnson | 43/18 R |
| 3,841,631 | 10/1974 | Dolan | 273/1.5 R |
| 3,854,168 | 12/1974 | Bradley | 17/44.2 |
| 3,880,392 | 4/1975 | Duganich | 248/324 |
| 3,896,987 | 7/1975 | Soja | 229/33 |
| 3,900,194 | 8/1975 | Ward et al. | 272/1 B |
| 3,918,711 | 11/1975 | Zak | 273/29 A |
| 3,929,225 | 12/1975 | Locke et al. | 206/335 |
| 3,936,206 | 2/1976 | Meisberger | 403/334 |
| 3,949,932 | 4/1976 | Shore | 229/40 |
| 4,009,779 | 3/1977 | Frye | 206/315 R |
| 4,009,780 | 3/1977 | Frye | 206/315 R |
| 4,017,998 | 4/1977 | Dumler | 43/21.2 |
| 4,061,367 | 12/1977 | Moebius | 285/382.2 |
| 4,114,764 | 9/1978 | Rich | 211/100 |
| 4,145,044 | 3/1979 | Wilson et al. | 273/1.5 R |
| 4,151,989 | 5/1979 | Dittrich | 273/1.5 A |
| 4,170,297 | 10/1979 | Johnson | 206/326 |
| 4,197,778 | 4/1980 | Wharton, Jr. | 93/36.01 |
| 4,289,298 | 9/1981 | Kameda | 254/8 B |
| 4,291,885 | 9/1981 | Cohen | 273/347 |
| 4,330,101 | 5/1982 | Andersen | 248/284 |
| 4,349,105 | 9/1982 | Bradley et al. | 206/317 |
| 4,377,283 | 3/1983 | Mahoney | 273/1.5 R |
| 4,412,679 | 11/1983 | Mahoney et al. | 273/1.5 R |
| 4,465,277 | 8/1984 | Dittrich | 273/1.5 A |
| 4,469,224 | 9/1984 | Ritter | 206/335 |
| 4,627,146 | 12/1986 | Ward | 29/458 |
| 4,653,646 | 3/1987 | Allen et al. | 206/579 |
| 4,684,129 | 8/1987 | Andersen et al. | 273/1.5 R |
| 4,735,392 | 4/1988 | Farmer | 248/439 |
| 4,747,597 | 5/1988 | Kluczny | 273/1.5 R |
| 4,759,545 | 7/1988 | Grable | 273/1.5 R |
| 4,769,897 | 9/1988 | Moseman | 29/525 |
| 4,826,162 | 5/1989 | Allen | 273/1.5 R |
| 4,842,134 | 6/1989 | Chang | 273/56 X |
| 4,842,152 | 6/1989 | Donegan | 215/294 |
| 4,869,501 | 9/1989 | Anastasakis | 273/1.5 R |
| 4,946,139 | 8/1990 | Tomellini | 256/64 |
| 4,979,754 | 12/1990 | Eisenhart | 273/411 |
| 5,014,983 | 5/1991 | Saunders | 273/1.5 R |
| 5,098,092 | 3/1992 | Aakre et al. | 273/1.5 R |
| 5,112,023 | 5/1992 | Sowers | 248/519 |
| 5,158,281 | 10/1992 | Williams | 273/1.5 R |
| 5,165,656 | 11/1992 | Schlessman et al. | 220/304 |
| 5,191,852 | 5/1993 | Rupp | 114/255 |
| 5,207,407 | 5/1993 | Fitzsimmons | 273/1.5 R X |
| 5,248,140 | 9/1993 | Matherne et al. | 273/1.5 R |
| 5,259,612 | 11/1993 | Matherne et al. | 273/1.5 R |

FOREIGN PATENT DOCUMENTS

| | | | |
|---|---|---|---|
| 2257389 | 6/1974 | Fed. Rep. of Germany | . |
| 544020 | 9/1922 | France | . |
| 755442 | 11/1933 | France | . |
| 261156 | 5/1970 | U.S.S.R. | . |
| 908055 | 10/1962 | United Kingdom | . |
| 1152846 | 5/1969 | United Kingdom | A63B 63/04 |

OTHER PUBLICATIONS

Huffy Sports, "7H20A Insta $H_2$oop," Products Brochure.

(List continued on next page.)

OTHER PUBLICATIONS

Huffy Sports, "Slam Jam," Product Brochure.
Lifetime Products, Inc., "HoopMobile Model 7100," Product Brochure.
Diversified Products, "Economy Portable Free-Standing Basketball Goal," Owners Manual.
Lifetime Products, Inc., "Quick Court-Portable Basketball System," Product Brochure.
Porter, "Future-Pro-Portable Basketball Units," Product Brochure.
Porter, "Porter '535' Portable-Universal Appeal," Product Brochure.
Porter, "State of the Art Technology," Product Brochure.
Porter, "Fiberglass Backboards," Product Brochure.
Porter, "Graphite Backboards," Product Brochure.
Porter, "Deluxe Graphite/Fiberglass Composite Backboard-The Hottest Product on the Market," Product Brochure.
Porter, "Basketball Poles," Product Brochure.
Porter, "Official Basketball Goals," Product Brochure.
Porter, "Mounting Brackets," Product Brochure.
Porter, "Basketball Nets," Product Brochure.
Porter, "Mini-Boards," Product Brochure.
Huffy Sports, "INSTA $H_2OOP$ Pole System Assembly 48" Backboard and Slam Jam Goal," Assembly Brochure.
Diversified Products, "AquaTite All-In-One," Product Brochure.
Diversified Products, "Ceramic All-In-One," Product Brochure.
Diversified Products, "All-In-One Basketball Set," Product Brochure.
Diversified Products, "Packaging Sequence for 40-0517C," Blue Prints.
Huffy Sports, "Ulta Packs," Product Brochure.
Lifetime Products, Inc., "Quick Court-Portable Basketball System," Instructions.
Lifetime Products, Inc., "Assembly of Quick Adjust Mechanism," Assembly Instructions.
Lifetime Products, Inc., "Accessories for Your Slam Dunk & Slam Dunk Pro System", Product Brochure.

APPARATUS AND METHOD FOR PACKAGING A PORTABLE BASKETBALL SYSTEM

RELATED U.S. APPLICATION

This application is a continuation in part of application Ser. No. 08/013,611, U.S. Pat. No. 5,248,140, filed Feb. 4, 1993 and entitled APPARATUS AND METHOD FOR PACKAGING A BASKETBALL GOAL SYSTEM WITH WEIGHT-FILLABLE BASE, and is also a continuation in part of application Ser. No. 07/941,989, U.S. Pat. No. 5,259,612, filed Sep. 8, 1992, and entitled PORTABLE SUPPORT FOR A BASKETBALL GOAL SYSTEM.

BACKGROUND

The Field of the Invention

The present invention is related to a basketball system with a weight-fillable base. More particularly, the present invention is related to a basketball system with a weight-fillable base having a unique design which enables the base to be moved when filled with ballast material and having a configuration that assists in the packaging of the component parts of the basketball system for shipment in a single relatively flat box.

Technical Background

As the game of basketball has increased in popularity, a greater number of people have purchased basketball systems for use at their homes. Such basketball systems typically include at least a pole to which a backboard and a goal is secured so that the goal is suspended above a playing surface. Heretofore most basketball systems were permanently mounted into the ground near the home's driveway, which serves as the basketball court because few homes have sufficient surrounding land to dedicate space for exclusive use as a basketball court.

In some instances, determining where to permanently mount a basketball system can be difficult. At some homes, for example, permanently mounting a basketball system next to the driveway could provide a risk to traffic in the driveway, resulting in danger or injury to players, automobiles, or the basketball system.

Sometimes the only viable location for a basketball system is a location where permanently mounting a basketball system cannot be easily accomplished. For instance, the ground may be covered by a layer of concrete or asphalt, so that mounting the pole in the ground would require breaking a hole in the concrete or asphalt and then repairing the hole after the pole has been affixed in the ground. Such a procedure could be expensive and would likely result in an unsightly driveway.

Permanently installed outdoor basketball systems suffer from other disadvantages as well. Because they are permanently mounted, they are generally exposed to the weather throughout the entire year. Constant exposure to the weather can cause the basketball system to prematurely wear by promoting oxidation. Premature oxidation can be particularly troublesome in systems having moving parts, such as poles and backboards that employ adjustable height mechanisms or breakaway goals. Constant exposure to the weather can cause these parts to prematurely fail.

Even permanently mounted basketball systems utilized in indoor environments suffer from some disadvantages. For example, a typical school has a gymnasium which must serve many purposes. Having several basketball systems permanently mounted for use in the gymnasium may preclude or at least interfere with certain other activities, even if the basketball systems are mounted on a wall or ceiling. On formal occasions, objection may be made to the appearance of permanently mounted basketball systems. The location of the permanently mounted basketball system may also interfere with other sporting activities.

In response to these and other disadvantages inherent in permanently mounted basketball systems, designs for portable basketball systems have been developed. In order for the portable basketball system to be effective, sufficient weight must be employed to maintain the pole, backboard, and goal in a generally rigid position for use in playing the game of basketball. Hence, some portable designs are extremely heavy, making the systems particularly difficult to move and possibly requiring the assistance of several people to set up or remove the system. Additionally, such designs can be prohibitively expensive for people desiring to purchase one for use at home.

Some prior-art designs have utilized removable weights, such as sand bags or metal weights, for use on a support structure which anchors the pole to the ground. A principal disadvantage to the use of these types of removable weights is that they can be extremely heavy to move from one place to another. While the support and the systems employing such designs may be easier to move, the weights are not. Some designs are extremely large and bulky because they employ long lever arms in an attempt to minimize the removable weights required by increasing the effective weight of those weights.

In an attempt to make a portable basketball system that is consumer affordable and ideal for use at home, some designs have employed a water-filled base. Such systems can be easily moved to a desired location where the base is then filled with water. The water-filled base provides sufficient weight to maintain the pole, backboard, and goal in a generally rigid position for use in playing basketball. When it is desired to move the system, the water is emptied out and the system moved. The principal advantage of such a system is that water is inexpensive, plentiful, and generally convenient to use.

Some portable basketball systems dispose the pole onto which the backboard and goal assembly is secured at an angle rather than employing a vertical pole. This is typically done to provide sufficient horizontal distance between the base, which is generally pyramidal in shape and extends outwardly in all directions from the pole, and the backboard. Such pyramidal bases are bulky and cannot easily be packaged for shipping in a single relatively flat box. Hence, packaging and shipping costs for transporting this type of portable basketball system are considerably more than they would be if the system could be packaged into a single relatively flat container. This expense is passed along to the consumer.

Moreover, most basketball backboards are designed to be secured to a vertical surface so that the rim portion of the goal lies in a horizontal plane above the playing surface. For example, most height adjustable systems, such as those disclosed and claimed in U.S. Pat. Nos. 4,781,375 and 4,805,904, require a vertical mounting surface. Of course, adapters may be employed, but they would unduly add to the cost and complexity of the system.

A significant demand exists for sturdy, low-cost, portable basketball systems. Consumers are looking for an affordable alternative to the permanently mounted basketball system, for the reasons outlined above. Retail marketers of basketball systems are looking for basketball systems that meet consumers' needs and also have additional qualities.

In particular, retailers seek portable basketball systems that can be easily displayed in a minimum of floor space and can be stacked to maximize inventory in the available shelf space. For example, a basketball system that can be packaged into a shipping carton that has a depth of about 14 inches can be stacked only six cartons high within a room with an 8 foot ceiling, while a carton of depth of about 8 inches can be stacked twelve cartons high in the same room. Such stacking ability also translates to significant shipping cost savings because more systems can be transported in a truck trailer or a box car.

Although various portable basketball systems have previously been developed, there have been no such systems that could be packaged into a relatively flat shipping carton (as used herein, the phrase "relatively flat" when applied to a shipping carton means a carton having a depth of about 12 inches or less). Typically, the base, whether it is a base that is ballast fillable or supports weights, required packaging that was not relatively flat.

Additionally, packing the component parts of the basketball system frequently required cardboard or styrofoam dividers to prevent undesirable shifting and damage to the components during shipping. Such dividers add cost to the price ultimately charged to the consumer and become waste to the consumer. It is not unusual for such dividers to add as much as five percent (5%) to the retail cost of the basketball system.

Thus, it would be an advancement in the art to provide a portable base for a basketball system which utilizes ballast secured within the base as a weight, but which can be easily moved by one person without having to remove the ballast from the base.

It would be a related advancement in the art to provide a base for a basketball system to which a pole could be secured in a substantially vertical position, thereby providing a vertical support to which could be attached a backboard and goal.

It would also be an advancement in the art if such a portable base could be provided which can receive liquid (e.g., water) or solid particles (e.g., sand) as ballast without leaking or spilling.

It would be a further advancement in the art to provide a portable base for a basketball goal system which has wheels that can support the effective weight of the system when the system is tilted from its upward position so that the system can be maneuvered from one place to another without requiring the removal of the ballast.

It would be a related advancement to provide such a portable basketball system which can be stored without disassembly in less space than the system requires when secured for play in an upward position.

It would be still another advancement in the art to provide a portable basketball system having component parts that are capable of assembly into a relatively flat carton for shipping.

It would be a related advancement to provide a portable basketball system whose base has an exterior contour that assists in the packaging of the components so that packing dividers are dramatically reduced or eliminated.

Such a system is disclosed and claimed herein.

BRIEF SUMMARY OF THE INVENTION

The present invention is directed to a portable basketball system with a ballast-fillable base that can be packaged for shipping into a relatively flat container such as a carton or box. During preassembly, the component parts of the basketball system can be positioned into a packaging and shipping assemblage that fits into an outer relatively flat container. The shape and size of the various component parts of the basketball system complement each other so that the parts fit snugly together in the carton, thereby drastically reducing or eliminating the need for cardboard or styrofoam dividers or spacers.

In one embodiment, the basketball system includes a pole and a base. Consumers may connect a previously acquired backboard and goal to the pole and connect the pole to the base to create a complete portable basketball system. The base is equipped with one or more wheels capable of serving as a rotating fulcrum upon which the effective weight of the basketball system may be supported so that the basketball system is maneuverable from place to place.

In a presently preferred embodiment, the basketball system includes a backboard, a basketball goal, a pole, a base, and a bracing assembly. The pole has a proximate end and a distal end and is preferably assembled by joining together a plurality of pole sections. The base has one or more wheels to promote maneuverability of the assembled basketball system.

The backboard may be connected to the pole near the distal end of the pole in any customary fashion that secures the plane of the backboard in a vertical plane. There are known in the art numerous ways to connect the backboard to the pole including adjustable mechanisms such as are taught in U.S. Pat. Nos. 4,781,375 and 4,805,904, angular support arms that connect a backboard to a pole that is disposed at an angle rather than vertical, and horizontal backboard support arms which may or may not be capable of adjusting the height of the backboard by sliding the support arm up and down the pole before rigidly securing the support arm.

The basketball goal typically comprises a connecting plate, a rim, and a net, and can be connected to the backboard in a customary fashion, either rigidly or by using a breakaway mechanism. The connecting plate is to be secured to the backboard so that the plane of the rim lies in a horizontal plane above a playing surface.

The base together with the bracing assembly may be connected to the pole to support the pole in a stationary, substantially upward position. As used herein, an "upward position" includes a stationary vertical position as well as a stationary position that is angled from the vertical but still suitable for playing basketball. The bracing assembly, which connects the pole and the base, is in pivotal engagement with the base. The bracing assembly includes a contractible collar which moves in slidable engagement with the pole unless a fastening assembly is tightened. The pole may therefore move between an upward position and a tilted position.

The upward position is suited for playing basketball, while the tilted position is preferred for moving or storing the basketball system. When the pole is held in its upward position, the fastening assembly is tightened to secure the collar to the pole so that the basketball goal is suspended at an elevation above the base and the playing surface upon which the base rests. When the pole is in its tilted position, it approaches the base, thereby reducing the overall height of the basketball system. When tilted, the basketball system may be stored in rooms whose height is less than the height of the basketball system in its upward position.

The base has a generally rectangular three-dimensional shape with a wheel end, a pole end, two sides, a top, and a bottom. The proximate end of the pole is to be connected to the base within a pole recess near the pole end of the base. A portion of the pole recess supports the pole when the pole is in the tilted position. The wheel or wheels are positioned at the wheel end of the base.

The base of the present invention has an interior hollow cavity for receiving ballast material and an exterior contour for receiving and retaining components such as the basketball goal, backboard, and pole sections within the container during pre-assembly. The hollow cavity is accessed through an opening preferably disposed in the wheel end of the base. A cap is provided to cover the opening so that the hollow cavity can be made water tight.

The base is designed to hold a predetermined amount of ballast material such that the weight of the ballast creates a sufficient moment about the pole end of the base where the pole connects to the base to counteract the moment about the pole end caused by the weight of the assembled pole, backboard, and basketball goal. The weight of the ballast material also provides sufficient support to the basketball system to maintain the system in a substantially rigid position during use of the basketball system in playing basketball.

The exterior contour of the base accommodates the receipt and retention of other component parts in an assemblage. The assemblage fits within a relatively flat container and impedes shifting movement of the pole sections, backboard, and basketball goal within the container during shipping. In one preferred embodiment, the exterior contour of the base has a goal recess for holding the basketball goal, and three notches for holding pole sections. The backboard may adjoin the base between other components such as the pole sections, or may be received and retained within a backboard recess in the base.

The pole sections have hollow interiors that serve as compartments for receiving and retaining therein smaller component parts of the basketball system such as the bracing assembly parts, the adjustment mechanism or other connecting structure used to secure the backboard to the pole, and any other hardware needed to assemble the basketball system. Smaller component parts may also be placed, preferably within bags or similar containers, inside the base in the hollow cavity that is designed to hold ballast when the basketball system is assembled.

By properly positioning the backboard near the base, the basketball goal within the goal recess, and the pole sections within the notches, the assemblage has exterior dimensions that permit insertion of the assemblage into a relatively flat container for transport. Since the recesses, notches, and adjoining parts hold the parts snugly, the base impedes the shifting movement of the pole sections, backboard, basketball goal, and other component parts within the container. Additionally, the need for cardboard or styrofoam dividers or spacers is eliminated or drastically reduced.

When fully assembled, the basketball system is moved by initially moving the pole toward the base and into the tilted position, and then rotating the basketball system onto the wheels and into a reclined position. The basketball system may then be rolled on the wheels to a new location. To permit the pole to move into the tilted position, the fastening assembly of the bracing assembly is loosened, thereby permitting the contractible collar to expand and then to slide along the pole as the pole moves toward the base.

The wheels provided at the wheel end of the base come into contact with the ground upon rotation of the basketball system into the reclined position. When the goal system is in its upward position, the wheels do not contact the ground. In the reclined position, with the basketball system supported upon the wheels, the system may be easily moved from one location to another.

These and other features and advantages of the present invention will become more fully apparent by examination of the following description of the preferred embodiments and the accompanying drawings.

DETAILED DESCRIPTION OF THE PREFERRED EMBODIMENTS

Figure 1:
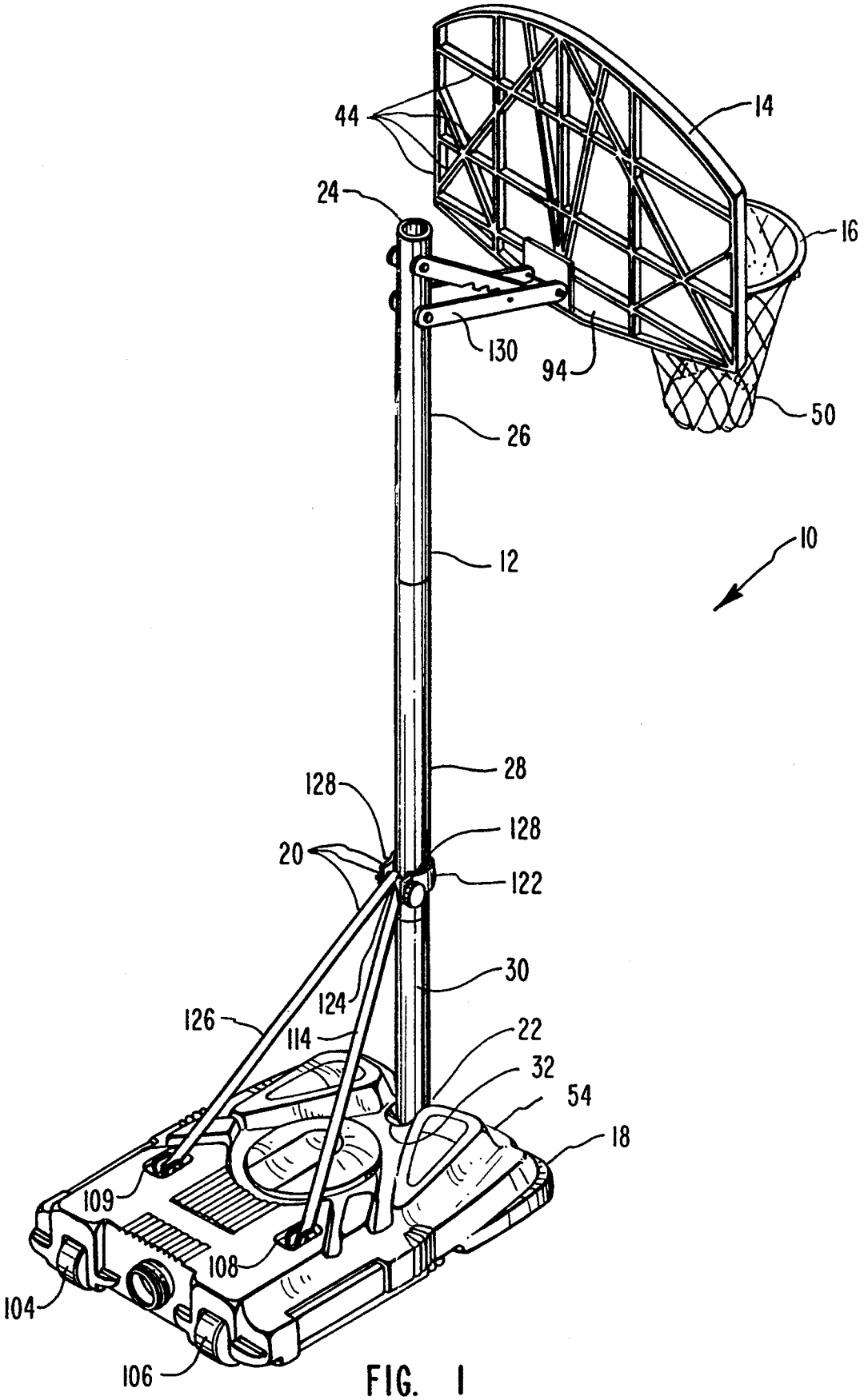
FIG. 1 is a perspective view of one embodiment of the portable basketball system with a ballast-filled base of the present invention as it would appear with a pole, backboard, and basketball goal attached to the base.

Reference is now made to the figures wherein like parts are referred to by like numerals throughout. With particular reference to FIG. 1, a portable basketball system according to the present invention is generally designated at 10. The basketball system 10 comprises a pole 12, a backboard 14, a basketball goal 16, a base 18, and a bracing assembly 20. The basketball system is assembled as illustrated in FIG. 1 from a basketball packaging and shipping assemblage such as the assemblage illustrated in FIG. 2.

With reference to FIG. 1, the pole has a proximate end 22 and a distal end 24 and preferably comprises a plurality of pole sections 26, 28, and 30 that join together end to end to form the pole 12. The pole sections 26, 28, and 30 may be joined together end to end in any conventional manner.

Figure 9:
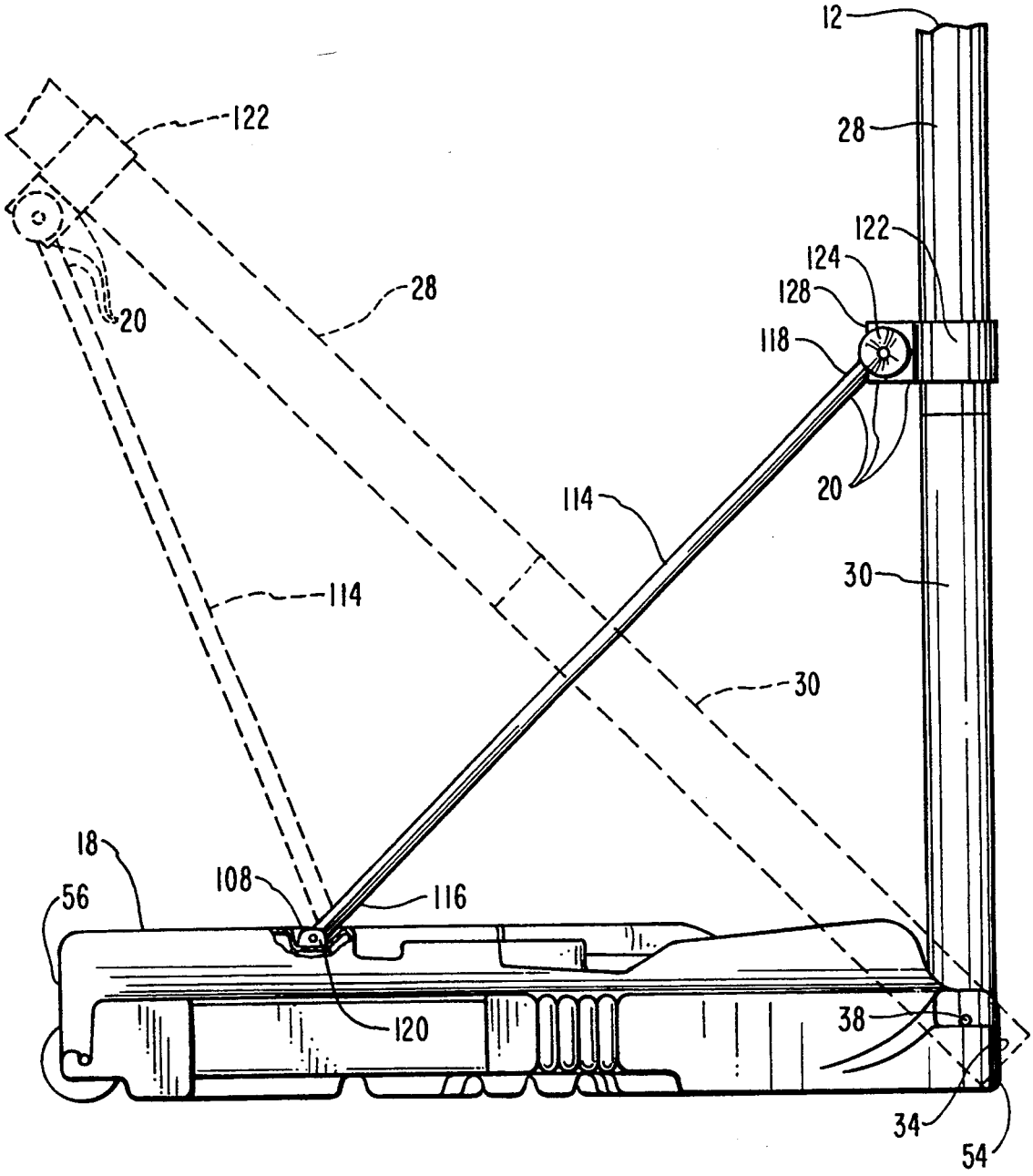
FIG. 9 is a side elevation view of a portion of the assembled basketball system illustrating the base, the bracing assembly, and the proximate end of the pole when the pole is in its upward position, with the pole's tilted position shown in phantom lines.

One section of the pole 12 is a pole mounting segment 30 which is attachable to the base 18 at a pole recess 32 in the base 18. The pole mounting segment 30 is preferably a cylindrical section having generally the same circumference dimension as the remainder of the pole 12. The pole mounting segment 30 is pivotally connected to the base 18 between two flanges 34, 36 located on each side of the pole recess 32, best shown in FIG. 3 and 5. As shown in FIG. 9, a fastener 38 extends through the pole mounting segment 30 and the flange 34 to provide an axis of rotation for the pole mounting segment 30. Such pivotal attachment about the fastener 38 enables the pole 12 to be rotated between a generally vertical upward position, as illustrated by FIG. 1 and by the solid lines of FIG. 9, and a tilted position, as illustrated by the phantom lines of FIG. 9.

The remainder of the pole 12 is attached to the pole mounting segment 30 by any of a variety of means known in the art for rigidly combining two cylindrical pieces. These methods may include utilizing the permanent fastener-free joint disclosed and claimed in U.S. Pat. No. 5,090,837. The base 18 is configured with a void 40, 42 on each side of the flanges 34, 36 to provide access to the fastener 38, as seen best in FIG. 7.

The backboard 14 is preferably constructed of a lightweight material such as polyethylene and reinforced by structural ribs 44, as shown best in FIG. 1. The backboard 14 may be connected to the pole 12 near the distal end 24 of the pole 12 in any customary fashion that secures the plane of the backboard 14 in a vertical plane. As disclosed above, there are numerous ways known in the art to connect the backboard 14 to the pole 12. One preferred way is to use an adjustable mechanism 28 of the type taught in U.S. Pat. No. 4,805,904. Each of these forms of connection are known in the art and the use of each is considered to be within the scope and intent of the present invention.

Figure 2:
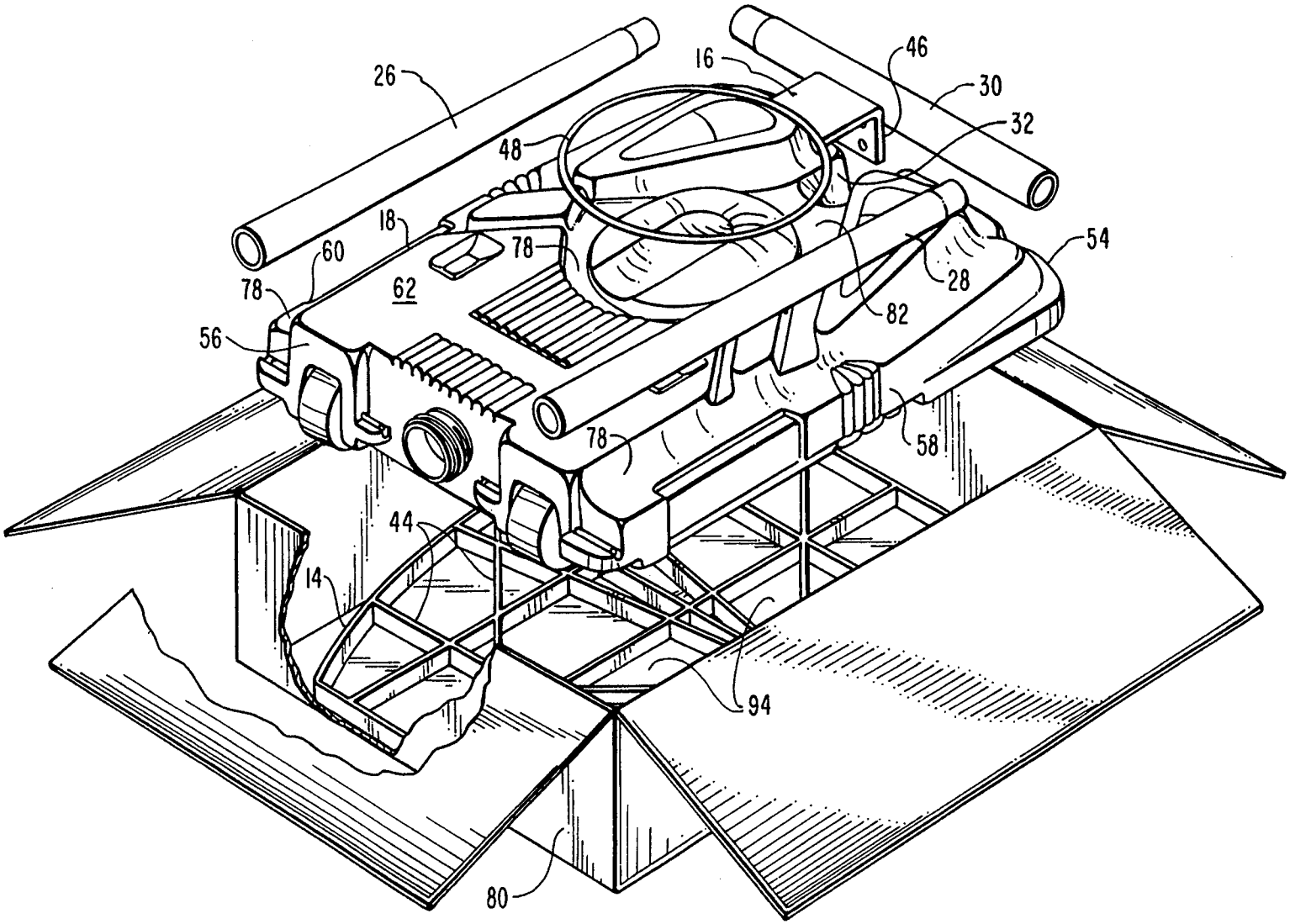
FIG. 2 is an exploded perspective view with a partial cut-away showing the base, backboard, pole, and goal of the basketball system of FIG. 1 in a preassembled state and positioned for disposition within a relatively flat container.

As shown in FIGS. 1 and 2, the basketball goal 16 typically comprises a connecting plate 46, a rim 48, and a net 50. The basketball goal 16 can be connected to the backboard 14 in a customary fashion, such as rigidly or by using a breakaway mechanism. In particular, the mounting mechanism for the basketball goal 16 may include a breakaway mounting mechanism such as that disclosed and claimed in U.S. Pat. No. 4,846,469. Whatever mounting mechanism is used, the connecting plate 46 is to be secured to the backboard 14 so that the plane of the rim 48 lies in a horizontal plane above a playing surface.

The base 18 is preferably constructed of a low-density linear polyethylene, although it will be appreciated that a variety of materials could be employed. The material forming the base 18 preferably can be structurally rigid but also somewhat flexible, can be molded into the desired shape, and is sturdy and rugged to withstand weather and rough play.

As illustrated in FIGS. 3 through 8, the base 18 has a generally rectangular three-dimensional shape with a pole end 54, a wheel end 56, two sides 58, 60, a top 62, and a bottom 64. The pole end 54 of the base 18 contains the pole recess 32 for receiving the proximate end 22 of the pole 12 (see FIG. 1). Within this pole recess 32, the pole 12 is to be connected to the base 18.

Figure 3:
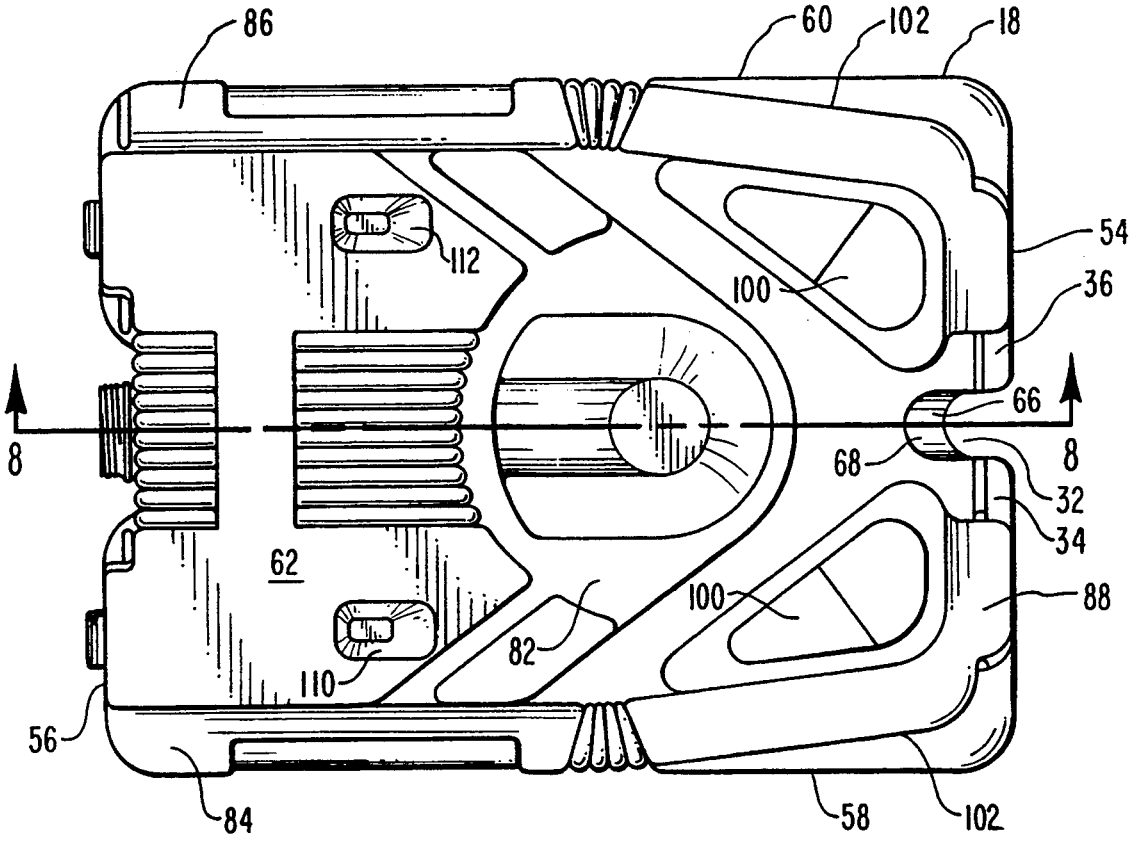
FIG. 3 is a top plan view of the basketball system base illustrated in FIG. 1 showing its generally rectangular shape and a preferred contour of the top of the base.
Figure 4:
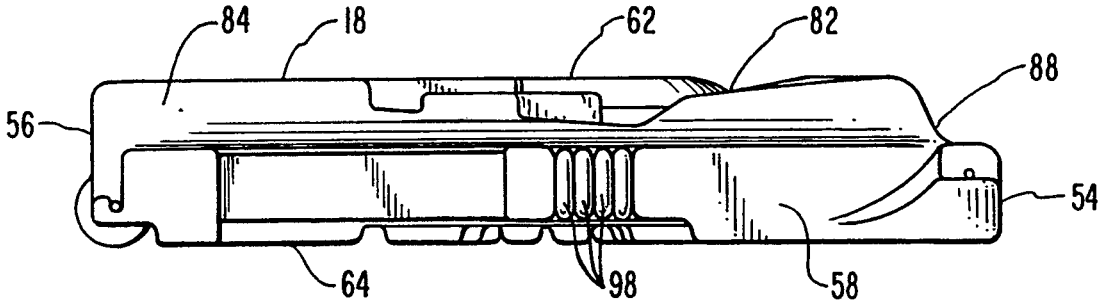
FIG. 4 is a side elevation view of the base for the basketball system of FIG. 1 illustrating the relative flatness of the base and the contour of the base as viewed from the side.
Figure 5:
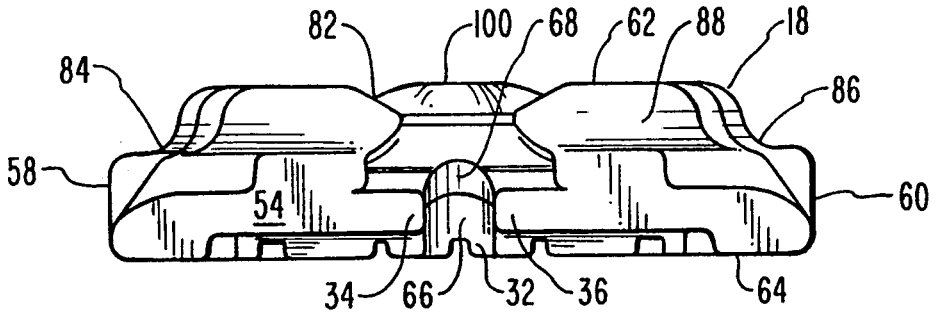
FIG. 5 is an elevation view of the pole end of the base for the basketball system of FIG. 1 illustrating the pole recess in a preferred frontal configuration of the base.

As shown in FIGS. 3 and 5, the pole recess 32 includes a vertical portion 66 configured to restrain the pole 12 from tilting away from the base 18 when the pole 12 is in its upward position (illustrated in FIGS. 1 and 9). The pole recess 32 also includes a tilted portion 68 configured to act in conjunction with the fastener 38 to restrain the pole 12 from too closely approaching the base 18 when the pole 12 is in its tilted position, as shown by the phantom lines in FIG. 9. The pole recess 32 thus acts as a safety mechanism for preventing further pivotal movement of the pole 12 substantially beyond the tilted position. If one were to permit the pole 12, backboard 14, and goal 16 to rotate freely under the force of their own weight, the pole recess 32 would act as a stop when the pole reaches the tilted position, thereby reducing the risk of damage or injury by inhibiting the goal 16 from crashing to the ground or tilting to an unstable configuration.

Figure 6:
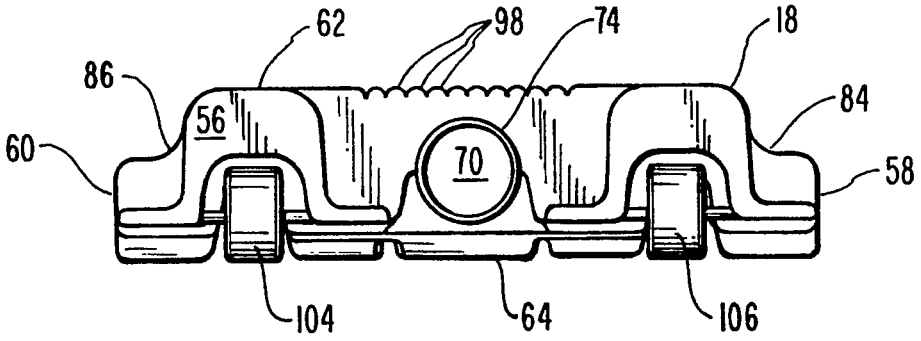
FIG. 6 is an elevation view of the wheel end of the base for the basketball system of FIG. 1 illustrating a preferred rear configuration of the base and showing the wheels upon which the basketball system may be supported during transport along a surface from one location to another.
Figure 7:
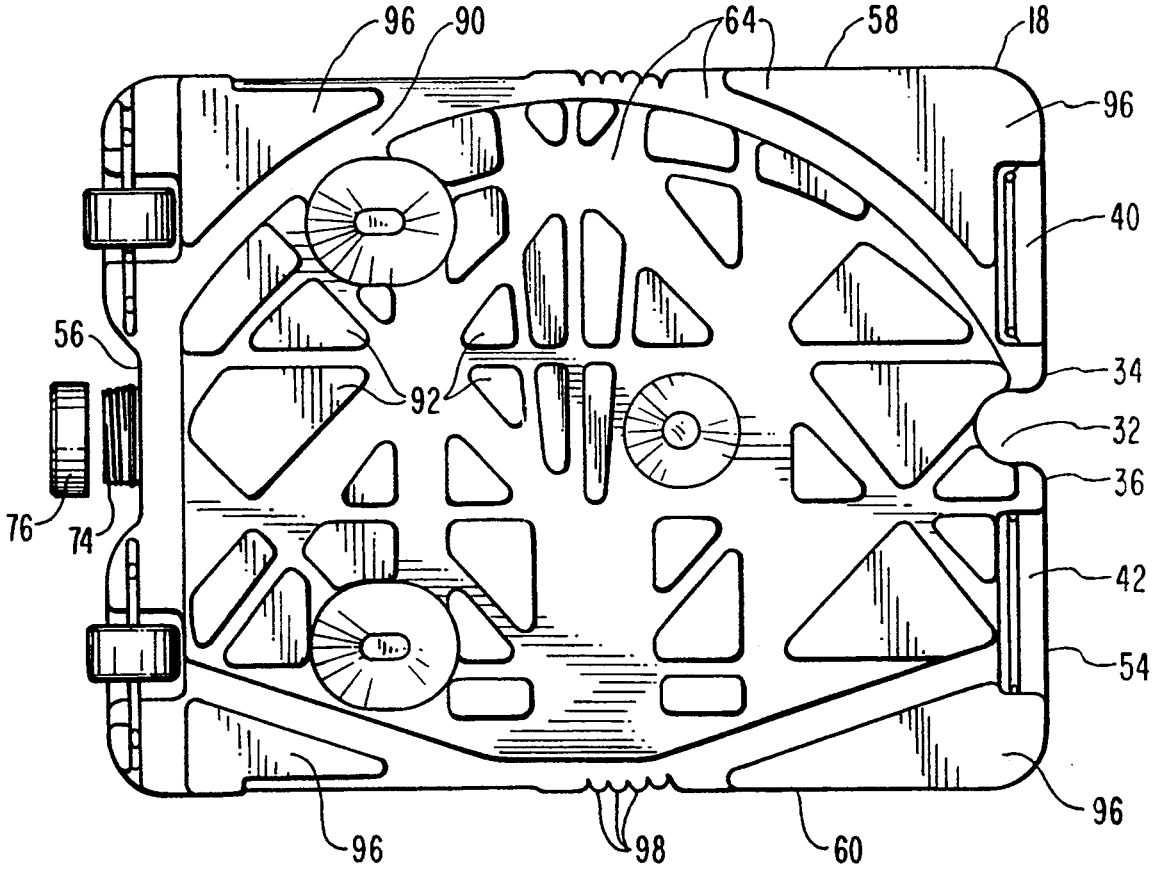
FIG. 7 is a plan view of the bottom of the base for the basketball system of FIG. 1 showing its generally rectangular shape and a preferred contour of the bottom of the base.
Figure 8:
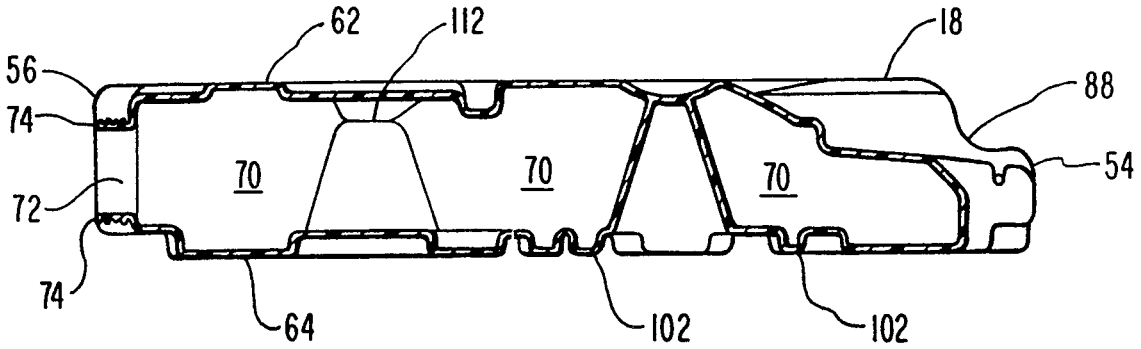
FIG. 8 is a transverse sectional view of the base for the basketball system of the present invention along line 8—8 of FIG. 3 showing the interior hollow cavity and the configuration of the base before ballast is introduced into the hollow cavity.

As illustrated in FIGS. 6 and 8, the base 18 has an interior hollow cavity 70 for receiving ballast material (not shown). The hollow cavity 70 is accessed through an opening 72 defined by a neck 74 and preferably disposed in the wheel end 56 of the base 18. A cap 76 (shown only in FIG. 7) is provided to engage the neck 74 and cover the opening 72 so that the hollow cavity 70 can be made water tight. Hence, the ballast material used to provide the weight needed to securely anchor the basketball system 10 to the playing surface during a basketball game may be a liquid such as water or a solid particle ballast such as sand, soil, metal beads or the like.

If the ballast used to fill the hollow cavity 70 is a liquid such as water, it is advisable to fill the hollow cavity 70 to a water level which leaves approximately 10 percent of the volume of the hollow cavity 70 empty. Leaving a void within the hollow cavity 70 ensures room for expansion in the event water within the hollow cavity 70 freezes. Because water expands as it freezes, expansion that is not accounted for could cause the base 18 to crack or otherwise fail.

Referring now to FIG. 1, the base 18 is designed to hold a predetermined amount of ballast material such that the weight of the ballast creates a sufficient moment about the pole end 54 of the base 18 where the pole 12 connects to the base 18 to counteract the moment about the pole end 54 caused by the weight of the assembled pole 12, backboard 14, and basketball goal 16. The weight of the ballast material also provides sufficient support to the basketball system 10 to maintain the system 10 in a substantially rigid position during use of the basketball system 10 in basketball games.

As shown in FIG. 2, the base 18 also has an exterior contour 78 for receiving and retaining the pole sections 26, 28, and 30, backboard 14, and basketball goal 16 within a container 80 during preassembly. The exterior contour 78 of the base 18 accommodates the receipt and retention of these component parts in an assemblage that impedes shifting movement of the parts within the container 80 during shipping. As further illustrated in FIG. 3, the exterior contour 78 of the base 18 has a goal recess 82 and three notches 84, 86, and 88.

The goal recess 82 is preferably disposed on the top 62 of the base 18 near the pole recess 32. In this manner, the basketball goal 16 may be disposed within the goal recess 82 with the connecting plate 46 disposed within the void defined by the pole recess 32 and the rim 48 resting in a circular groove portion of the goal recess 82 (see FIG. 2). The goal recess 82 is capable of receiving and retaining the basketball goal 16 in snug but removable engagement.

Preferably, each notch 84, 86, and 88 is disposed on the top 62 of the base 18 along an edge of the base 18, although such notches 84, 86, and 88 may be disposed elsewhere within the exterior contour 78 of the base 18 and still serve their function as described herein. As best shown in FIG. 2, each notch 84, 86, and 88 has a depth (approximating the diameter of the pole 12) and a length (approximating the length of a pole section 26, 28, or 30) appropriate for receiving and retaining at least one of the pole sections 26, 28, and 30 in fitted removable engagement.

In one preferred embodiment, a backboard recess 90 such as is shown in FIG. 7 is disposed on the bottom 64 of the base 18. The backboard recess 90 has a depth, size, and shape appropriate for receiving and retaining the backboard 14 in secure but removable engagement (see FIG. 2). Thus, in embodiments of the invention including a backboard 14 with structural ribs 44, the backboard recess 90 preferably has protrusions 92 configured to fit within cavities 94 between the structural ribs 44. These protrusions 92 serve to increase the ballast capacity of the base 18 and to impede shifting movement of the backboard 14 within the shipping container 80. As shown in FIG. 2, the backboard 14 is received into the backboard recess 90 so that the backboard 14 is disposed flat on the floor of the container 80.

Having the backboard recess 90 on the bottom 64 of the base 18 as shown in FIG. 7 is presently preferred. However, it should be understood that different exterior contours may accommodate the backboard recess 90 on the top 62 of the base 18, while still other exterior contours may lack a backboard recess 90.

As FIG. 7 also shows, the bottom 64 of the base 18 has skid plates 96. The skid plates 96 serve as friction footings against the playing surface 52 (shown only in FIG. 10) when the base 18 is filled with ballast and the assembled basketball system 10 is disposed in its upward position for use in playing basketball as shown in FIG. 1.

When the base 18 is filled with ballast, the bottom 64 of the base 18 will deflect towards the playing surface 52. To compensate for this deformation, a built-in arc is provided in the bottom 64. Thus, when the base 18 is filled with ballast, the unique design of the bottom 64 permits the skid plates 96 to lay flat against the playing surface 52, and prevents the sagging of the bottom 96. Otherwise, only the outside corner of the skid plates 96 would contact the playing surface 52, causing premature wear of the skid plates 96 and sagging stress on the base 18.

As illustrated in FIGS. 3 through 8, the exterior contour 78 of the base 18 may employ a combination of structural ribs 98, bubbles 100, or ridges 102 to strengthen the structural integrity of the base 18 and/or increase the ballast capacity of the base 18 by increasing the size of the interior hollow cavity 70. Such structural ribs 98, bubbles 100, and ridges 102 decrease deformation or sagging of the base 18 under the weight of the ballast or other pressures.

Although a particular preferred embodiment of the exterior contour 78 of the base 18 is shown in the figures, it should be understood that any contour that facilitates the packaging of the component parts of the basketball system 10 into an assemblage that is relatively flat is contemplated and intended to be within the spirit and scope of the present invention. For instance, the particular disposition of the goal recess 82 and the notches 84, 86, and 88 may be altered from that shown in the figures without departing from the scope of the invention. Indeed, another preferred embodiment includes no backboard recess 90. Instead, the backboard 14 adjoins the base 18 and other parts of the basketball packaging and shipping assemblage inside the shipping container 80.

In another alternative embodiment, the assemblage packed in the container 80 includes no backboard 14 or goal 16. The assembled basketball system in such an alternative embodiment resembles the basketball system 10 shown in FIG. 1, but the backboard and goal are previously acquired by a consumer rather than being obtained as part of a basketball packaging and shipping assemblage like the one shown in FIG. 2.

FIG. 6 shows the wheel end 56 of the base 18 and wheels 104, 106 disposed to facilitate the movement of the basketball system 10 from one place to another. The wheels 104, 106 are disposed at the wheel end 56 of the base 18 so that the wheels 104, 106 come into contact with the ground 52 upon rotation of the basketball system 10 from the upward into a reclined position (see FIG. 10), as will be explained in more detail below. When the basketball system 10 is in its upward position, the wheels 104, 106 do not contact the ground or playing surface 52. In the reclined position, the effective weight of the basketball system 10 is supported upon the wheels 104, 106, and the system 10 may be easily moved from one location to another.

As best illustrated in FIGS. 1 and 9, the bracing assembly 20 connects to the pole 12 and the base 18 to provide bracing support so that the pole 12 may be held in a stationary upward position. The stationary upward position may be vertical, or may be angled from the vertical but still appropriate for playing basketball. When the pole 12 is held in such an upward position, the pole 12 is secured so that the basketball goal 16 is suspended at an elevation above the base 18 and the playing surface 52 upon which the base 18 rests. When the pole 12 is in its upward position, the basketball system 10 is ready for use by basketball players playing a game of basketball.

Two clevises 108, 109 are attached to the base 18 near the wheel end 56 of the base 18 in two indentations 110, 112 known as kisses. The kisses 110, 112 occur where the top 62 and the bottom 64 of the base 18 meet inside the hollow base 18, as shown in FIG. 8. As shown best in FIG. 9, a bracing arm 114 having a base end 116 and a pole end 118 is pivotally attached to the clevis 108 by an axle 120 at the arm's base end 116. The pole end 118 of the bracing arm 114 is pivotally attached to a contractible collar 122 which is disposed for sliding engagement along the pole 12. A nut and bolt assembly 124 is employed to attach the support arm 114 pivotally to the collar 122, although any suitable type of pivotal connection can be used. The second bracing arm 126 is similarly attached to the second clevis 109 and the contractible collar 122.

The contractible collar 122 extends around the pole 12. Flanges 128 are configured into the collar 122 between which the pole ends of the bracing arms 114, 126 are held. A fastening assembly 124 may be employed to secure the flanges 128 and the pole ends of the bracing arms 114, 126 together and to tighten the collar 122 around the pole 12, thereby locking the bracing arms 114, 126 to the pole 12 in a range of positions. The contractible collar 122 and fastening assembly 124 may, for example, be of the type disclosed and claimed in U.S. patent application Ser. No. 07/941,989. A presently preferred contractible collar 122 has a split configuration, thereby allowing the circumference of the collar 122 to be adjusted. However, one of skill in the art will appreciate that other configurations may be utilized in constructing a contractible collar for use in accordance with the teachings of the present invention.

To enable the pole 12 to pivot with respect to the base 18, the bracing assembly 20 is slidably secured to the pole 12. Thus, as the pole 12 pivots and moves from the upward position (solid lines in FIG. 9) toward the tilted position (phantom lines in FIG. 9), the bracing assembly 20 supports the pole 12 while permitting the pole 12 to tilt toward the base 18. Tilting reduces the total vertical height of the basketball system 10, thereby facilitating storage of the basketball system 10.

To assemble the basketball system 10 of the present invention as shown in FIG. 1, the backboard 14 is connected to the pole 12 near its distal end 24. The basketball goal 16 is connected to the backboard 14. The hollow ballast-receiving base 18 is connected to the pole 12 near its proximate end 22 so that the basketball goal 16 is suspended at an elevation above the base 18 and the playing surface 52. The bracing assembly 20 is then secured to the pole 12 and the base 18 so that the pole 12 is supported in a stationary, substantially upward position. For safety reasons it is advisable to fill the base 18 with ballast before securing the pole 12 into its upward position because the weight of the ballast is needed to counteract the moment about the pole end 54 of the base 18 created by the weight of the pole 12, backboard 14, and basketball goal 16. When so assembled, the basketball system 10 is ready for play.

Figure 10:
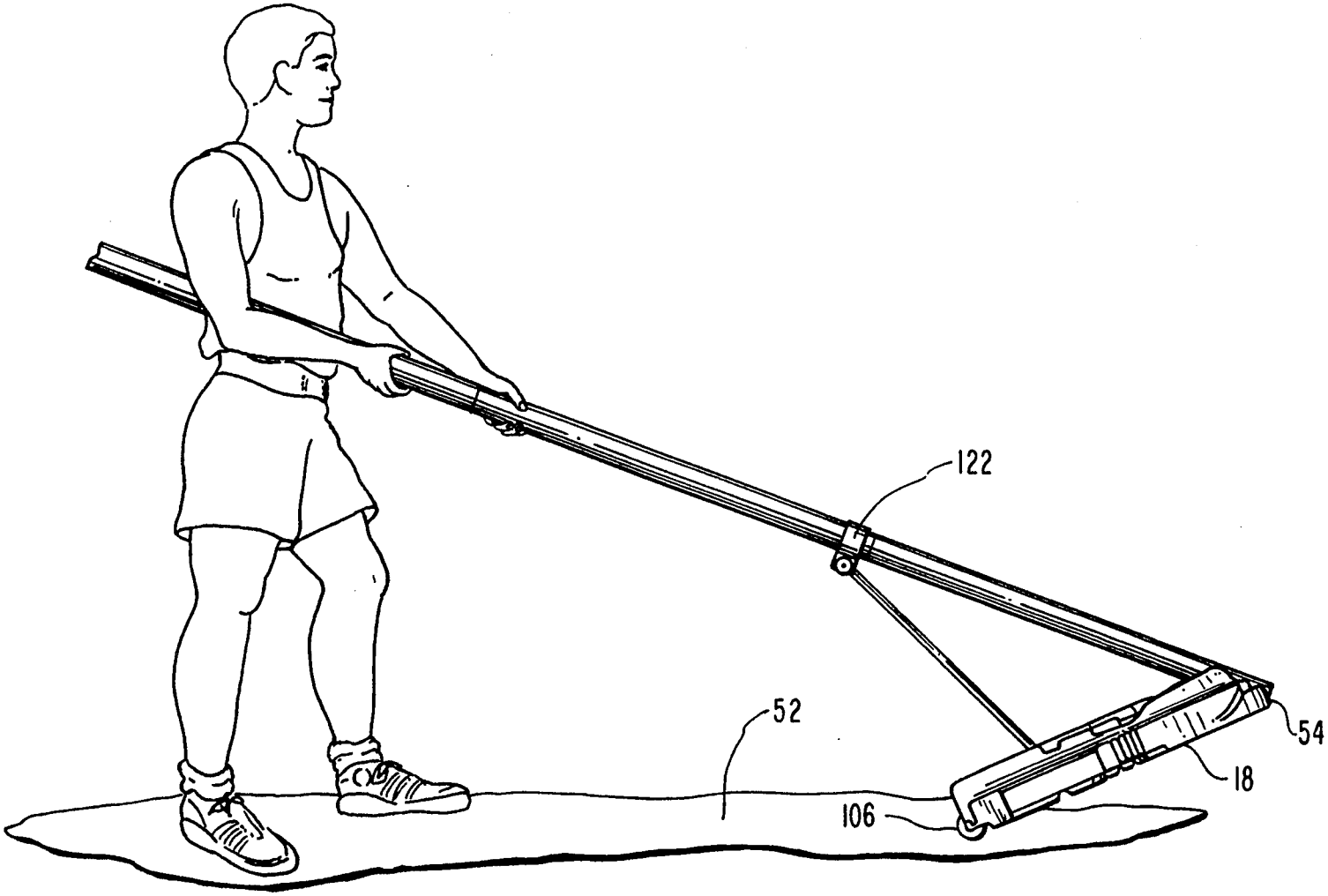
FIG. 10 is a perspective view of a preferred embodiment the basketball system of FIG. 1 with the goal system in its reclined position, illustrating how the goal system may be moved from one location to another.

When fully assembled, the basketball system 10 is moved by initially moving the pole 12 into a tilted position and rotating the basketball system 10 into a reclined position, as illustrated in FIG. 10. The wheels 104, 106 provided at the wheel end of the base 18 come into contact with the ground or playing surface 52 upon rotation of the basketball system 10 into the reclined position. In such a reclined position, the effective weight of the basketball system 10 is the weight experienced by the wheels 104, 106 resulting from the weight of the system 10 as affected by the countervailing forces acting as moments about the wheels 104, 106. This effective weight is supported upon the wheels 104, 106 and the wheels 104, 106 serve as a rotating fulcrum for the system 10. In this manner, the basketball system 10 may be easily moved by one person from one location to another without requiring the removal of the ballast from the base 18.

The component parts of the basketball system 10 can, in a preassembled state, form an assemblage that facilitates packaging and shipment. As best shown in FIG. 2, the component parts can form an assemblage that is capable of disposition within a relatively flat container 80. The pole sections 26, 28, and 30 have hollow interiors that serve as compartments for receiving and retaining therein smaller component parts of the basketball system 10 such as parts of the bracing assembly 20, a connecting structure used to secure the backboard 14 to the pole 12, and other hardware needed to assemble the basketball system 10. Hence, by inserting the smaller component parts into the pole sections 26, 28, and 30, no increase in exterior dimension is added to the packaging and shipping assemblage.

By positioning the backboard 14 within the backboard recess 90, the basketball goal 16 within the goal recess 82, and the pole sections 26, 28, and 30 within the notches 84, 86, and 88, the assemblage has exterior dimensions that permit the insertion of the assemblage into the relatively flat container 80 for transport. Small articles of hardware can be retained within any of the pole sections 26, 28, or 30 and prevented from undesirable jostling within the container 80 by placing such articles in a bag and/or placing the bag about one or more of the pole sections 26, 28, and 30. A bag thus disposed can also assist in preventing undesirable scratching of the exterior of the pole 12. Parts may also be inserted in the hollow cavity 70 inside the base 18.

Since the recesses 82, 90 and notches 84, 86, and 88 hold the parts snugly, the base 18 impedes the shifting movement of the pole sections 26, 28, and 30, backboard 14, basketball goal 16, and other small component parts within the container 80. Additionally, the need for cardboard or styrofoam dividers or spacers is eliminated or drastically reduced because the base 18 serves as the dividers or spacers.

To prepare the assemblage for shipping, the backboard 14 is positioned within the backboard recess 90. The basketball goal 16 is positioned within the goal recess 82. The remaining component parts that will fit into the pole sections 26, 28, or 30 are inserted into the pole sections and the pole sections 26, 28, and 30 are positioned within notches 84, 86, and 88 or within the hollow cavity 70 through the opening 72. The assemblage so formed is then inserted into the container 80. If the basketball system 10 comprises an adjustable mechanism 130 (see FIG. 1) for adjustably connecting the backboard 14 to the pole 12 so that the height of the basketball goal 16 above said base 18 is adjustable, then the component parts of the adjustable mechanism 130 are inserted within at least one of the pole sections 26, 28, or 30 prior to positioning that pole section with relation to the base 18.

Hence, it can be seen from the foregoing that the present invention includes a portable basketball system 10 with a ballast-filled base 18 which can be easily moved from one location to another without removing the ballast from the base 18. The invention provides such a basketball system 10 which is uniquely designed such that in a preassembled state its component parts can be positioned to fit into a relatively flat shipping container 80.

It should be appreciated that the apparatus and methods of the present invention are capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by patent is:

1. A basketball packaging and shipping assemblage for disposition within an outer relatively flat container and capable of assembly with a backboard and basketball goal into a basketball system, the packaging and shipping assemblage comprising:

a plurality of pole sections capable of assembly to form a pole having a proximate end and a distal end;

a hollow ballast-receiving base capable of assembly with said pole and with the backboard and the basketball goal to form the basketball system wherein said base supports said pole in a stationary, substantially upward position and is connected to said pole near the proximate end of said pole and the basketball goal is connected to the backboard which is connected to said pole so that the basketball goal is suspended at an elevation above said base, said base having an exterior contour for receiving and retaining said pole sections within the container and impeding shifting movement of said pole sections within the container during shipping, the exterior contour of said base comprising at least one notch for receiving and retaining at least one of said pole sections within the container.

2. A basketball packaging and shipping assemblage as defined in claim 1, wherein said base further comprises at least one wheel disposed on said base to be capable of serving as a rotating fulcrum upon which the effective weight of the basketball system may be supported so that the basketball system is maneuverable from place to place.

3. A basketball packaging and shipping assemblage as defined in claim 2, wherein said wheel is disposed on said base such that said wheel serves as a rotating fulcrum supporting the effective weight of the basketball system only if said pole is tilted from said upward position.

4. A basketball packaging and shipping assemblage as defined in claim 2, wherein said base has a pole end capable of supporting said pole in said upward position, and said base also has a wheel end distal from said pole end, said wheel being disposed on said base at said wheel end.

5. A basketball packaging and shipping assemblage for disposition within an outer relatively flat container and capable of assembly into a basketball system, comprising:

a plurality of pole sections capable of assembly to form a pole having a proximate end and a distal end;

a backboard for connection to said pole near the distal end of said pole;

a basketball goal for connection to said backboard;

a hollow ballast-receiving base capable of assembly with said pole, backboard, and basketball goal to form the basketball system wherein said base supports said pole in a stationary, substantially upward position and is connected to said pole near the proximate end of said pole and said basketball goal is connected to said backboard which is connected to said pole so that said basketball goal is suspended at an elevation above said base, said base having an exterior contour for receiving and retaining said pole sections and basketball goal within the container, for adjoining said backboard within the container, and for impeding shifting movement of said pole sections, backboard, and basketball goal within the container during shipping, the exterior contour of said base comprising:

a goal recess for receiving and retaining said basketball goal within the container; and at least one notch for receiving and retaining at least one of said pole sections within the container.

6. A basketball packaging and shipping assemblage as defined in claim 5, wherein said base has a top side and a bottom side and said goal recess is disposed in the top side of said base.

7. A basketball packaging and shipping assemblage as defined in claim 5, wherein said base has a top side and a bottom side and said notch is disposed in the top side of said base.

8. A basketball packaging and shipping assemblage as defined in claim 5, wherein said exterior contour of said base further comprises a backboard recess for receiving and retaining said backboard within the container.

9. A basketball packaging and shipping assemblage as defined in claim 8, wherein said backboard comprises structural ribs defining backboard rib cavities and said exterior contour of said base has protrusions disposed within said backboard recess, said protrusions configured to be received within at least a portion of said backboard rib cavities for impeding shifting movement of said backboard within the container during shipping.

10. A basketball packaging and shipping assemblage as defined in claim 5, wherein said base further comprises at least one wheel disposed on said base to be capable of serving as a rotating fulcrum upon which the effective weight of the basketball system may be supported so that the basketball system is maneuverable from place to place.

11. A basketball packaging and shipping assemblage as defined in claim 10, wherein said wheel is disposed on said base such that said wheel serves as a rotating fulcrum supporting the effective weight of the basketball system only if said pole is tilted from said upward position.

12. A basketball packaging and shipping assemblage as defined in claim 10, wherein said base has a pole end capable of supporting said pole in said upward position, and said base also has a wheel end distal from said pole end, said wheel being disposed on said base at said wheel end.

13. A basketball packaging and shipping assemblage as defined in claim 5, wherein said base further comprises an opening into a hollow cavity within said base and a cap for covering said opening so that said hollow cavity is water-tight, whereby said hollow cavity is capable of receiving and retaining water as ballast.

14. A basketball packaging and shipping assemblage as defined in claim 5, wherein said base further comprises an opening into a hollow cavity within said base and a cap for covering said opening and enclosing said hollow cavity so that said base is capable of receiving and retaining solid particles as ballast.

15. A basketball packaging and shipping assemblage as defined in claim 5, further comprising an adjustment mechanism for adjustably connecting said backboard to said pole so that the height of said basketball goal above said base is adjustable, said adjustment mechanism being capable of disposition within at least one of said pole sections during shipping.

16. A basketball packaging and shipping assemblage as defined in claim 5, further comprising a bracing assembly for bracing said pole and for regulating the movement of said pole between said upward position and a tilted position wherein said pole is disposed at an angle to said upward position, the bracing assembly comprising:

a bracing arm having a base end and a pole end, said bracing arm capable of pivotal engagement with said base at said base end;

a contractible collar connectable to said pole end of said bracing arm in pivotal engagement, said collar being capable of slidable engagement with said pole, thereby permitting relative movement between said bracing arm and said pole; and a fastening assembly connectable to said collar such that tightening of said fastening assembly forces said collar to contract thereby firmly securing said collar to said pole and loosening of said fastening assembly permits said collar to expand thereby allowing said collar to slide relative to said pole such that said pole may be moved between said upward position and said tilted position.

17. A basketball packaging and shipping assemblage as defined in claim 5, wherein said base has a pole recess for receiving and retaining the proximate end of said pole and for regulating the movement of said pole between said upward position and a tilted position wherein said pole approaches said base and a portion of said pole recess supports said pole at an angle to said upward position.

18. A basketball packaging and shipping assemblage for disposition within an outer relatively flat container and capable of assembly into a basketball system, comprising:

a plurality of pole sections capable of assembly to form a pole having a proximate end and a distal end;

a backboard for connection to said pole near the distal end of said pole;

a basketball goal for connection to said backboard;

a hollow ballast-receiving base capable of assembly with said pole, backboard, and basketball goal to form the basketball system wherein said base supports said pole in a stationary, substantially upward position and is connected to said pole near the proximate end of said pole and said basketball goal is connected to said backboard which is connected to said pole so that said basketball goal is suspended at an elevation above said base, said base having an exterior contour for receiving and retaining said pole sections and basketball goal within the container, for adjoining said backboard within the container, and for impeding shifting movement of said pole sections, backboard, and basketball goal within the container during shipping, the exterior contour of said base comprising a goal recess for receiving and retaining said basketball goal within the container and at least one notch for receiving and retaining at least one of said pole sections within the container;

a wheel disposed on said base to be capable of serving as a rotating fulcrum upon which the effective weight of the basketball system may be supported so that the basketball system is maneuverable from place to place; and a bracing assembly for bracing said pole and for regulating the movement of said pole between said upward position and a tilted position wherein said pole is disposed at an angle to said upward position, the bracing assembly comprising:

a bracing arm having a base end and a pole end, said bracing arm capable of pivotal engagement with said base at said base end;

a contractible collar connectable to said pole end of said bracing arm in pivotal engagement, said collar being capable of slidable engagement with said pole, thereby permitting relative movement between said bracing arm and said pole; and a fastening assembly connectable to said collar such that tightening of said fastening assembly forces said collar to contract thereby firmly securing said collar to said pole and loosening of said fastening assembly permits said collar to expand thereby allowing said collar to slide relative to said pole such that said pole may be moved between said upward position and said tilted position.

19. A basketball packaging and shipping assemblage as defined in claim 18, wherein said wheel is disposed on said base such that said wheel serves as a rotating fulcrum supporting the effective weight of the basketball system only if said pole is tilted from said upward position.

20. A basketball packaging and shipping assemblage as defined in claim 18, wherein said exterior contour of said base further comprises a backboard recess for receiving and retaining said backboard within the container.

21. A basketball packaging and shipping assemblage as defined in claim 20, wherein said backboard comprises structural ribs defining backboard rib cavities and said exterior contour of said base has protrusions disposed within said backboard recess, said protrusions configured to be received within at least a portion of said backboard rib cavities for impeding shifting movement of said backboard within the container during shipping.

22. A basketball packaging and shipping assemblage as defined in claim 18, wherein said base further comprises an opening into a hollow cavity within said base and a cap for covering said opening so that said hollow cavity is water-tight, whereby said hollow cavity is capable of receiving and retaining water as ballast.

23. A basketball packaging and shipping assemblage as defined in claim 18, wherein said base further comprises an opening into a hollow cavity within said base and a cap for covering said opening and enclosing said hollow cavity so that said base is capable of receiving and retaining solid particles as ballast.

24. A basketball packaging and shipping assemblage as defined in claim 18, further comprising an adjustment mechanism for adjustably connecting said backboard to said pole so that the height of said basketball goal above said base is adjustable, said adjustment mechanism being capable of disposition within at least one of said pole sections during shipping.

* * * * *